US006299521B1

(12) United States Patent
Morimura et al.

(10) Patent No.: US 6,299,521 B1
(45) Date of Patent: Oct. 9, 2001

(54) POLISHING SHEET

(75) Inventors: Yasuhiro Morimura; Hidefumi Kotsubo, both of Kodaira (JP)

(73) Assignee: Bridgestone Corporation, Tokyo (JP)

( * ) Notice: Subject to any disclaimer, the term of this patent is extended or adjusted under 35 U.S.C. 154(b) by 452 days.

(21) Appl. No.: 08/773,304

(22) Filed: Dec. 24, 1996

(30) Foreign Application Priority Data

Dec. 26, 1995 (JP) ..... 7-351565
Dec. 26, 1995 (JP) ..... 7-351566

(51) Int. Cl.[7] ..... B24D 3/34

(52) U.S. Cl. ..... 451/533; 451/534; 451/538; 451/539; 51/293

(58) Field of Search ..... 457/533, 534, 457/538, 539; 51/293, 295, 298

(56) References Cited

U.S. PATENT DOCUMENTS 4,128,972 * 12/1978 Charvat ..... 51/298
4,938,784 * 7/1990 Murakami et al. ..... 51/193
5,007,975 * 4/1991 Yamamoto et al. ..... 156/154
5,036,629 * 8/1991 Ishikuro et al. ..... 451/533
5,360,462 * 11/1994 Harmer et al. ..... 51/295
5,391,210 * 2/1995 Bilkadi et al. ..... 51/298
5,454,844 * 10/1995 Hibbard et al. ..... 51/295
5,573,560 * 11/1996 Kobayashi et al. ..... 51/293
5,611,825 * 3/1997 Engen et al. ..... 51/295

* cited by examiner

*Primary Examiner*—Joseph J. Hail, III
*Assistant Examiner*—George Nguyen
(74) *Attorney, Agent, or Firm*—Sughrue, Mion, Zinn, Macpeak & Seas, PLLC

(57) ABSTRACT

The invention provides a polishing sheet comprising a support and an abrasive layer formed thereon with an adhesive layer interposed therebetween, characterized in that the adhesive layer is formed by a cured layer of a thermosetting and/or photo-curable curable adhesive composition based on at least one resin selected from the group consisting of (A) an ethylene-vinyl acetate copolymer, (B) a copolymer of ethylene, vinyl acetate, and an acrylate and/or methacrylate monomer, (C) a copolymer of ethylene, vinyl acetate, and maleic acid and/or maleic anhydride, (D) a copolymer of ethylene, an acrylate and/or methacrylate monomer, and maleic acid and/or maleic anhydride, and (E) an ionomer resin in the form of an ethylene-methacrylic acid copolymer whose molecules are bonded by a metal ion.

26 Claims, 1 Drawing Sheet

POLISHING SHEET

BACKGROUND OF THE INVENTION

This invention relates to a polishing sheet for use in grinding, polishing, cutting and otherwise machining metal, lens, semiconductor and liquid crystal substrates and other workpieces.

Prior art polishing sheets are generally classified into polishing sheets, known as grinding stone, obtained by mixing particulate or powdery abrasive grains for grinding, polishing and cutting with a binder and firing the mixture at elevated temperature and polishing sheets obtained by applying a mixture of abrasive grains and a binder onto a support of fabric, paper, film, fiber, non-woven fabric or the like to bind abrasive grains thereon.

All these polishing sheets are used by fixedly securing them to a polishing or grinding tool which can be rotated at a high speed.

All these polishing sheets, however, have the drawback that they do not perform well for polishing or grinding because the instant a high speed rotating polishing sheet is brought into contact with a workpiece, the polishing sheet is sprung off due to the lack of elasticity in a thickness direction. Polishing at a reduced number of revolutions was thus practiced, but this approach was not satisfactory in either polishing efficiency or precision.

As one improvement in this respect, matrixes based on relatively elastic natural rubber or synthetic rubber were sometimes used as a binder for abrasive grains. These matrixes are poor in bond to abrasive grains and heat resistance as a polishing sheet. None of currently available polishing sheets are truly practical.

SUMMARY OF THE INVENTION

An object of the present invention is to provide a polishing sheet which has overcome the problems of prior art polishing sheets during high speed polishing or grinding operation and is improved in polishing efficiency and precision.

In a first embodiment, the present invention provides a polishing sheet comprising a support and an abrasive layer formed thereon with an adhesive layer interposed therebetween, characterized in that, the adhesive layer is formed by a cured layer of a thermosetting and/or photo-curable adhesive composition based on at least one resin selected from the group consisting of (A) an ethylene-vinyl acetate copolymer, (B) a copolymer of ethylene, vinyl acetate, and an acrylate and/or methacrylate monomer, (C) a copolymer of ethylene, vinyl acetate, and maleic acid and/or maleic anhydride, (D) a copolymer of ethylene, an acrylate and/or methacrylate monomer, and maleic acid and/or maleic anhydride, and (E) an ionomer resin in the form of an ethylene-methacrylic acid copolymer whose molecules are bonded by a metal ion.

In a second embodiment, the present invention provides a polishing sheet comprising a support and an abrasive layer formed thereon directly or with an adhesive layer interposed therebetween, characterized in that, the abrasive layer comprises abrasive grains and a binder which is a thermosetting and/or photo-curable adhesive composition based on at least one resin selected from the group consisting of (A) an ethylene-vinyl acetate copolymer, (B) a copolymer of ethylene, vinyl acetate, and an acrylate and/or methacrylate monomer, (C) a copolymer of ethylene, vinyl acetate, and maleic acid and/or maleic anhydride, (D) a copolymer of ethylene, an acrylate and/or methacrylate monomer, and maleic acid and/or maleic anhydride, and (E) an ionomer resin in the form of an ethylene-methacrylic acid copolymer whose molecules are bonded by a metal ion, the abrasive grains being bound with a cured product of the adhesive composition.

In the second embodiment, it is preferred that the adhesive layer is also formed by a cured layer of either one of the above-defined resins (A) to (E).

In conjunction with a polishing sheet comprising a support and an abrasive layer formed thereon with an adhesive layer interposed therebetween, we have found that when the adhesive layer is formed by a cured product of a thermosetting adhesive composition based on the above-defined resin and preferably containing an organic peroxide as a curing agent (or crosslinking agent), or a photo-curable adhesive composition based on the above-defined resin and preferably containing a photosensitizer as a curing agent (or crosslinking agent), more preferably a thermosetting or photo-curable adhesive composition further comprising a silane coupling agent or an acryloxy, methacryloxy or allyl group-containing compound, there is obtained a polishing sheet which has overcome the above-mentioned drawbacks of prior art polishing sheets and is improved in polishing efficiency and precision. We have further found that similar results are also obtained when the above-defined thermosetting or photo-curable adhesive composition is used as a binder of the abrasive layer. The present invention is predicated on these findings.

DETAILED DESCRIPTION OF THE INVENTION

Figure 1:
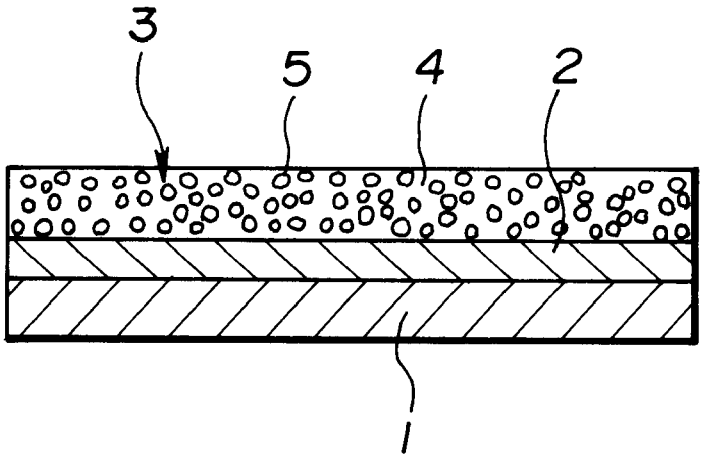
FIG. 1 is a cross sectional view of a polishing sheet according to one embodiment of the invention.

In the first embodiment of the invention, a polishing sheet has an abrasive layer 3 formed on a support 1 with an adhesive layer 2 interposed therebetween as shown in FIG. 1. The adhesive layer 2 is formed by a cured layer of a thermosetting or photo-curable adhesive composition based on a resin selected from the above-mentioned resins (A) to (E).

Figure 2:
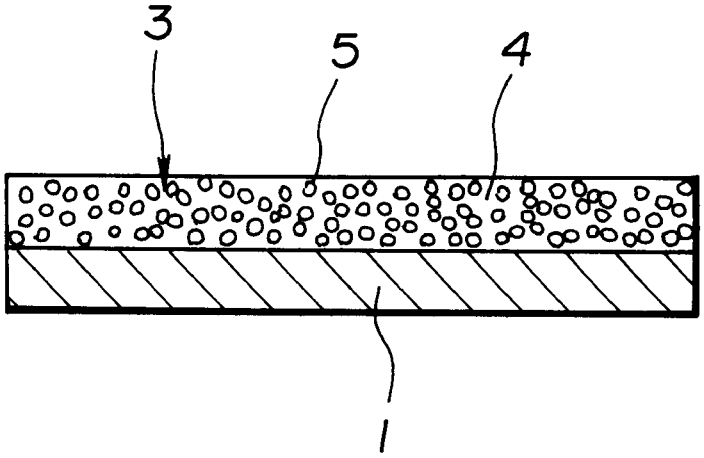
FIG. 2 is a cross sectional view of a polishing sheet according to another embodiment of the invention.

In the second embodiment of the invention, a polishing sheet is of the same construction as in FIG. 1 or has an abrasive layer 3 formed directly on a support 1 as shown in FIG. 2, wherein the above-mentioned thermosetting or photo-curable adhesive composition is used as a binder 4 of the abrasive layer 3 whereby abrasive grains 5 are bound with a cured product thereof. In the second embodiment, when an adhesive layer 2 is formed as shown in FIG. 1, it is preferred that the adhesive layer 2 is also formed by a cured layer of the above-mentioned thermosetting or photo-curable adhesive composition.

It is noted that the adhesive layer 2 is not necessarily limited to a single layer structure and may have a multi-layer structure wherein the first embodiment requires that at least one of such multiple layers be formed by a cured layer of the above-mentioned thermosetting or photo-curable adhesive composition.

The above-mentioned thermosetting or photo-curable adhesive composition is described in detail. The thermosetting or photo-curable adhesive composition contains as a major component a resin selected from resins (A) to (E) as shown below. Preferably, at least one of an acryloxy group-containing compound, methacryloxy group-containing compound and allyl group-containing compound and a silane coupling agent are blended with the resin. Also an organic peroxide or photosensitizer is preferably used as a curing or crosslinking agent. This ensures integral uniting of the abrasive layer to the support and achieves an improvement in polishing efficiency and precision during high speed rotation. Also in this case, a cured layer of this composition should preferably have a storage elastic modulus in the range of $1\times10^7$ to $5\times10^9$ dyne/cm$^2$ at 25° C. and 15 Hz in order to ensure achievement of these improvements.

Resin

Included are (A) an ethylene-vinyl acetate copolymer, (B) a copolymer of ethylene, vinyl acetate, and an acrylate and/or methacrylate monomer, (C) a copolymer of ethylene, vinyl acetate, and maleic acid and/or maleic anhydride, (D) a copolymer of ethylene, an acrylate and/or methacrylate monomer, and maleic acid and/or maleic anhydride, and (E) an ionomer resin in the form of an ethylene-methacrylic acid copolymer whose molecules are bonded by a metal ion.

The ethylene-vinyl acetate copolymer used as resin (A) in the practice of the invention should preferably have a vinyl acetate content of 5 to 50% by weight, more preferably 10 to 45% by weight. A vinyl acetate content of less than 5% by weight would lead to a too high storage elastic modulus at 25° C. and 15 Hz whereas a vinyl acetate content of more than 50% by weight would inversely lead to a too low storage elastic modulus and sometimes detract from heat resistance.

In the copolymer of ethylene, vinyl acetate, and an acrylate and/or methacrylate monomer used as resin (B), the content of a vinyl acetate unit should preferably be 4 to 50% by weight, more preferably 14 to 45% by weight. A vinyl acetate unit content of less than 4% by weight would lead to a too high storage elastic modulus at 25° C. and 15 Hz whereas a vinyl acetate unit content of more than 50% by weight would inversely lead to a too low storage elastic modulus and sometimes detract from heat resistance. The content of an acrylate and/or methacrylate unit should preferably be 0.01 to 10% by weight, more preferably 0.05 to 5% by weight. If the content of this unit is less than 0.01% by weight, the degree of crosslinking and heat resistance would sometimes lower. A content in excess of 10% by weight would lower a storage elastic modulus and deteriorate polishing efficiency.

In the copolymer of ethylene, vinyl acetate, and maleic acid and/or maleic anhydride used as resin (C), the content of a vinyl acetate unit should preferably be 10 to 50% by weight, more preferably 14 to 45% by weight. A vinyl acetate unit content of less than 10% by weight would lead to a too high storage elastic modulus at 25° C. and 15 Hz whereas a vinyl acetate unit content of more than 50% by weight would inversely lead to a too low storage elastic modulus and sometimes detract from heat resistance. The content of a maleic acid and/or maleic anhydride unit should preferably be 0.01 to 10% by weight, more preferably 0.05 to 5% by weight. If the content of this unit is less than 0.01% by weight, the binding of abrasive grains would sometimes be deteriorated. A content in excess of 10% by weight would sometimes lower the cohesion of an abrasive layer and deteriorate polishing efficiency.

In the copolymer of ethylene, an acrylate and/or methacrylate monomer, and maleic acid and/or maleic anhydride used as resin (D), the content of an acrylate and/or methacrylate unit should preferably be 5 to 50% by weight, more preferably 14 to 45% by weight. An acrylate and/or methacrylate unit content of less than 5% by weight would lead to a too high storage elastic modulus at 25° C. and 15 Hz whereas a content of more than 50% by weight would inversely lead to a too low storage elastic modulus and sometimes detract from heat resistance.

The content of a maleic acid and/or maleic anhydride unit should preferably be 0.01 to 10% by weight, more preferably 0.05 to 5% by weight. A content of less than 0.01% by weight would lead to a less improvement in adhesive force whereas a content in excess of 10% by weight would sometimes detract from processability.

It is noted that the acrylate and methacrylate monomers which can be used herein are acrylic acid, methacrylic acid, and esters thereof, for example, lower alkyl esters of (meth) acrylic acid wherein the alkyl group has 1 to 5 carbon atoms, such as methyl (meth)acrylate and ethyl (meth)acrylate as well as glycidyl (meth)acrylate. These monomers may be used alone or in admixture of two or more.

In the ionomer resin in the form of an ethylene-methacrylic acid copolymer whose molecules are bonded by a metal ion which is used as resin (E), the content of methacrylic acid in the ethylene-methacrylic acid copolymer should preferably be 1 to 30% by weight, more preferably 5 to 25% by weight. A methacrylic acid content of less than 1% by weight would lead to a too high storage elastic modulus at 25° C. and 15 Hz whereas a content of more than 30% by weight would inversely lead to a too low storage elastic modulus and sometimes detract from heat resistance.

The metal ions which can be used herein are metal cations such as sodium, zinc, magnesium, and lithium. The ionomer resin preferably has a degree of ionization by the metal ion of 5 to 80 mol %, more preferably 7 to 70 mol %.

Moreover, the adhesive composition based on the above-mentioned resin can be improved in high-temperature performance and controlled in storage elastic modulus by further adding at least one of an acryloxy group-containing compound, a methacryloxy group-containing compound, and an allyl group-containing compound to the resin as mentioned above.

The acryloxy and methacryloxy group-containing compounds which can be used for this purpose are derivatives of acrylic acid and methacrylic acid, for example, esters thereof. Exemplary alcohol residues of the esters are alkyl groups having 1 to 24 carbon atoms, especially 1 to 18 carbon atoms such as methyl, ethyl, dodecyl, stearyl, and lauryl as well as cycloalkyl groups having 3 to 6 carbon atoms such as cyclohexyl; and halo, hydroxyl, amino and otherwise substituted alkyl groups (wherein the alkyl group has 1 to 24 carbon atoms, especially 1 to 18 carbon atoms) such as tetrahydrofurfuryl, aminoethyl, 2-hydroethyl, 3-hydroxypropyl, and 3-chloro-2-hydroxypropyl groups; and glycidyl groups. Also useful are esters of acrylic acid and methacrylic acid with polyfunctional alcohols such as ethylene glycol, triethylene glycol, and polyethylene glycol.

Examples of the allyl group-containing compound include diallyl phthalate, diallyl fumarate, diallyl maleate, triallyl isocyanurate, and triallyl cyanurate.

It is noted that these compounds may be used alone or in admixture of two or more. A blending amount of up to 50 parts by weight per 100 parts by weight of the resin is satisfactory, preferably 0.1 to 50 parts by weight, more preferably 0.5 to 20 parts by weight. Less than 0.1 part of the compound would detract from heat resistance whereas more than 50 parts of the compound would detract from the ease of preparation of a composition and its film forming ability.

In the practice of the invention, a silane coupling agent is preferably added to the adhesive composition based on the above-mentioned resin for the purpose of further improving the adhesion to the support and to a binder and abrasive grains used in the abrasive layer. The silane coupling agents which are used for this purpose are well-known ones including, for example, γ-chloropropyltrimethoxy-silane, vinyltrichlorosilane, vinyltriethoxysilane, vinyl-tris(β-methoxyethoxy)silane, γ-methacryloxypropyltrimethoxy-silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxy-silane, and N-β-(aminoethyl)-γ-aminopropyltrimethoxysilane.

A blending amount of the silane coupling agent of up to 10 parts by weight per 100 parts by weight of the resin is satisfactory, preferably 0.1 to 10 parts by weight, more preferably 0.01 to 5 parts by weight.

Also, epoxy group-containing compounds other than epoxysilanes may be added as an adhesion promoter. Examples of the epoxy group-containing compound include triglycidyl tris(2-hydroxyethylene)isocyanurate, neopentylglycol diglycidyl ether, 1,6-hexanediol glycidyl ether, allyl glycidyl ether, 2-ethylhexyl glycidyl ether, phenyl glycidyl ether, phenol polyoxyethylene (5 mol) glycidyl ether, p-t-butylphenyl glycidyl ether, diglycidyl ester of adipic acid, glycidyl ester of o-phthalic acid, glycidyl methacrylate, and butyl glycidyl ether. Similar effects are obtainable using a polymer alloy of an epoxy group-containing polymer. The epoxy group-containing compounds may be used alone or in admixture of two or more. An addition amount of generally 0 to 20 parts by weight, especially 0.1 to 20 parts by weight per 100 parts by weight of the resin is satisfactory.

When the composition of the invention is to be thermoset, an organic peroxide may be added thereto. It may be any of organic peroxides which decompose at a temperature of 70° C. or higher to generate radicals, preferably organic peroxides having a decomposition temperature affording a half life of 10 hours of 50° C. or higher. A choice may be made while taking into account conditions of preparation, coating, and attachment to a support and an abrasive layer.

Examples of the peroxide which can be used herein include 2,5-diemethylhexane-2,5-dihydroperoxide, 2,5-dimethyl-2,5-di(t-butylperoxy)hexine-3, di-t-butyl peroxide, t-butylcumyl peroxide, 2,5-dimethyl-2,5-di(t-butylperoxy)-hexane, dicumyl peroxide, α,α'-bis(t-butylperoxyisopropyl)-benzene, n-butyl-4,4'-bis(t-butylperoxy)valerate, 1,1-bis(t-butylperoxy)cyclohexane, 1,1-bis(t-butylperoxy)-3,3,5-trimethylcyclohexane, butyl peroxybenzoate, benzoyl peroxide, t-butyl peroxyacetate, methyl ethyl ketone peroxide, 2,5-dimethylhexyl-2,5-bisperoxybenzoate, t-butyl hydroperoxide, p-menthane hydroperoxide, p-chlorobenzoyl peroxide, t-butylperoxyisobutyrate, hydroxyheptyl peroxide, chlorohexanone peroxide, octanoyl peroxide, decanoyl peroxide, lauroyl peroxide, cumyl peroxyoctoate, succinic acid peroxide, acetyl peroxide, t-butylperoxy(2-ethylhexanoate), m-toluoyl peroxide, benzoyl peroxide, and 2,4-dichlorobenzoyl peroxide.

The organic peroxides may be used alone or in admixture of two or more, generally in amounts of 0.1 to 10 parts by weight per 100 parts by weight of the resin.

On the other hand, when the composition of the invention is to be photoset, a photosensitizer may be added thereto. The preferred photosensitizer used is a radical photo-polymerization initiator.

Among the radical photo-polymerization initiators, hydrogen abstraction type initiators used herein are benzophenone, methyl ortho-benzoylbenzoate, 4-benzoyl-4'-methyldiphenyl sulfide, isopropylthioxanthone, diethylthioxanthone, ethyl-4-(diethylamino)benzoate, etc. Among the radical photo-polymerization initiators, intramolecular cleavage type initiators used herein are benzoin ether, benzyl dimethyl ketal, etc. and a-hydroxyalkylphenone type initiators are 2-hydroxy-2-methyl-1-phenylpropan-1-one, 1-hydroxycyclohexyl phenyl ketone, alkylphenylglyoxylates, diethoxyacetophenone, etc. Furthermore, α-aminoalkylphenone type initiators are 2-methyl-1-[4-(methylthio)phenyl]-2-morpholinopropane-1, 2-benzyl-2-dimethylamino-1-(4-morpholinophenyl)-butanone-1, etc. Acylphosphine oxide, etc. are also useful.

The photosensitizers may be used alone or in admixture of two or more in amounts of 0.1 to 10 parts by weight per 100 parts by weight of the resin.

It is understood that in the adhesive composition of the invention, the photosensitizer and the organic peroxide may be used together whereby photo-curing and thermosetting take place in combination.

As previously mentioned, the adhesive composition used herein should preferably have in cured form a storage elastic modulus in the range of $1\times10^7$ to $5\times10^9$ dyne/cm$^2$ as measured under conditions of 25° C. and 15 Hz. If the storage elastic modulus exceeds $5\times10^9$ dyne/cm$^2$, an adhesive composition layer as cured would be too hard, rather preventing the rotational speed of a polishing tool from being increased and accordingly, inviting a drop of polishing efficiency. If the storage elastic modulus is less than $1\times10^7$ dyne/cm$^2$, the resulting composition can accommodate high speed rotation, but the mechanical strength of the curable composition layer and the rate of dissipation of strains upon stress relief during polishing would be reduced, resulting in a lowering of polishing precision. It is noted that the storage elastic modulus is measured according to JIS K 7213.

It is understood that in order to control the storage elastic modulus within the above-defined range for a particular purpose, a hydrocarbon resin may be added insofar as the objects of the invention are not impaired. The hydrocarbon resin used herein may be either naturally occurring or synthetic.

Preferred natural resins used herein include rosin, rosin derivatives, and terpene resins. Gum resins, tall oil resins and wood resins may be used as the rosin. Useful rosin derivatives are hydrogenated, disproportionated, polymerized, and esterified products of rosin as well as metal salts of rosin. The terpene resins include terpene resins such as α-pinene and β-pinene and terpene-phenol resins. Other useful natural resins are dammar, copal, and shellac. As to the synthetic resin, petroleum resins, phenolic resin, and xylenic resins are preferably used. The petroleum resins include aliphatic petroleum resins, aromatic petroleum resins, alicyclic petroleum resins, copolymeric petroleum resins, hydrogenated petroleum resins, pure monomeric petroleum resins, and coumarone-indene resins. The phenolic resins include alkyl phenol resins and modified phenolic resins. The xylenic resins include xylene resins and modified xylene resins.

The hydrocarbon resin is generally added in an amount of 0 to 200 parts by weight, preferably 5 to 150 parts by weight, more preferably 10 to 100 parts by weight per 100 parts by weight of the resin.

In addition to the above-mentioned additives, antioxidants, dyes, processing aids, UV absorbing agents, etc. may be added to the adhesive composition of the invention insofar as the objects of the invention are not impaired.

The support constituting the polishing sheet should preferably be heat resistant. Examples of such support include sintered supports obtained by firing inorganic and metallic binders such as feldspar, soluble clay, frit binders, magnesia, and oxychloride binders, and supports based on organic resins having a glass transition temperature of 60° C. or higher or a melting point of 100° C. or higher.

Examples of the heat resistant organic resin include polyester resins such as polyethylene terephthalate, polycyclohexylene terephthalate, and polyethylene naphthalate; polyamide resins such as nylon 46, modified nylon 6T, nylon MXD6, and polyphthalamide; thioether resins such as polyphenylene sulfide and polythioethersulfone; ketone resins such as polyether ether ketone and polyallyl ether ketone; sulfone resins such as polysulfone and polyether sulfone; and polyether nitrile, polyarylates, polyether imides, polyamide imides, polycarbonate, polymethyl methacrylate, and triacetyl cellulose. Supports based on such organic resins are useful.

Sintered bodies of inorganic materials are preferred supports of polishing sheets because of heat resistance during polishing. Where organic materials are used, it is preferred to use heat resistant supports based on organic resins having a glass transition temperature of 60° C. or higher and/or a melting point of 100° C. or higher.

Next, the abrasive layer used herein may be provided either by securing particulate or powdery abrasive grains commonly used for grinding, polishing and cutting purposes directly on the surface of an adhesive composition layer by coating or spraying means or by forming a uniform mixture of abrasive grains and a binder on the surface of an adhesive composition layer.

With respect to the abrasive grains used in the abrasive layer according to the invention, a proper choice may be made in accordance with a particular purpose among naturally occurring abrasive grains such as corundum, emery, garnet, borax, tripoli, pumice, diatomaceous earth, dolomite, and diamond; and artificial abrasive grains such as alumina, silicon carbide, composite oxides, boron carbide, tungsten carbide, lime, rouge, crocus, chromium oxide, magnesium oxide, boron nitride, and artificial diamond. The mean grain size may be selected within the range of 0.001 to 1,000 $\mu$m.

The binders which can be used herein include binders based on feldspar, soluble clay and frit; sulfur vulcanized products of natural or synthetic rubber; magnesia and oxychloride binders; and adhesive binders of phenol resins, epoxy resins, urethane resins, silicone resins, and acrylic resins.

Also, the above-mentioned thermosetting or photo-curable adhesive composition may be used as a binder as previously mentioned. In the embodiment wherein the thermosetting or photo-curable adhesive composition of the invention is used as a binder, abrasive grains and the thermosetting or photo-curable adhesive composition are preferably used in such amounts that 10 to 10,000 parts by weight, more preferably 20 to 5,000 parts by weight, most preferably 50 to 1,000 parts by weight of abrasive grains are present per 100 parts by weight of the resin in the adhesive composition. Less than 10 parts by weight of abrasive grains would result in lower polishing efficiency whereas with more than 10,000 parts by weight of abrasive grains, the cohesion of the abrasive layer would lower and abrasive grains are likely to fall off, failing to increase polishing precision.

No particular limit is imposed on the thickness of the abrasive layer although a thickness of at least 1 $\mu$m is satisfactory and a thickness of 1 $\mu$m to 5 mm is preferred. No particular limit is imposed on the thickness of the support although a thickness of at least 5 $\mu$m is satisfactory and a thickness of 5 $\mu$m to 5 mm is preferred.

Some exemplary methods for preparing the polishing sheet according to the invention are illustrated below although the invention is not necessarily limited to these methods and any method may be used insofar as the objects of the invention are attainable.

First, the adhesive composition can be prepared and formed into a film by weighing predetermined amounts of the resin, curing agent (organic peroxide or photosensitizer), silane coupling agent, acryloxy, methacryloxy or allyl group-containing compound, etc., uniformly mixing these components in a kneading mixer such as a roll mill and kneader, and applying the composition to form a film of desired width and thickness by film-forming means such as a calender roll, T-die extruder and blown-film extruder.

Herein, the film thickness is preferably 1 to 1,000 $\mu$m, more preferably 5 to 800 $\mu$m. With a film thickness of less than 1 $\mu$m, polishing by high speed rotation would be difficult whereas a film thickness of more than 1,000 $\mu$m would detract from polishing precision.

The thus formed composition layer can be applied to the support by conventional methods, for example, a bonding lamination method by means of a hot press, a direct lamination method using an extruder and calender, and a heat pressure bonding method using a film laminator.

Alternatively, components of the adhesive composition are uniformly mixed and dissolved in a good solvent to form a solution, which is directly applied to the support by a flow coating, spraying, roll coating, spin coating or casting method whereupon the solvent is dried off to form a film. Alternatively, the solution is once applied to a support which has been subject to release treatment, the solvent is dried off, and the resulting composition layer is transferred to and laid on a heat resistant support.

The abrasive layer of the polishing sheet according to the invention may be formed either by providing particulate or powdery abrasive grains onto a laminate of the support and the composition layer by coating, spraying or shot applying means or by forming a uniform mixture of abrasive grains and a binder by a similar method. For binding of abrasive grains with a binder, a well-known method may be used.

With respect to curing treatment of the thermosetting adhesive composition, part or the entirety of the adhesive composition may be cured when it forms a laminate with the support. Alternatively, the remainder or the entirety of the adhesive composition may be cured after an abrasive layer is formed on the laminate. Although conditions under which the adhesive composition layer is cured depend on the type of organic peroxide used, heating at a temperature of 70 to 170° C., especially 70 to 150° C. for 2 to 60 minutes, especially 5 to 30 minutes is preferred. In this case, it is preferred from the standpoint of bonding to effect curing by heating under a pressure of 0.01 to 50 kgf/cm$^2$, especially 0.1 to 20 kgf/cm$^2$.

With respect to curing treatment of the photo-curable adhesive composition, on the other hand, part or the entirety of the adhesive composition may be cured when it forms a laminate with the support, as in the foregoing embodiment. Alternatively, the remainder or the entirety of the adhesive composition may be cured after an abrasive layer is formed on the laminate. With respect to conditions under which the adhesive composition layer is cured, curing can be effected by irradiating ultraviolet radiation to the laminate from a mercury lamp or the like. For a shorter curing time or an increased degree of curing, it is convenient to irradiate ultraviolet radiation while heating the polishing sheet or laminate at 40 to 120° C.

The manner of attaching the polishing sheet of the invention to a grinding, polishing or cutting tool is not particularly limited and conventional methods may be used. For example, there can be employed a method of applying a tackifier or adhesive to the back surface of the polishing sheet of the invention and attaching it to the tool; a method of laminating a simple attachment member such as magic tape to the back surface of the polishing sheet of the invention and attaching it to the tool; and an attachment method of perforating holes in the polishing sheet of the invention which mate with bosses on the tool. Also employable are an attachment method of mechanically fastening the polishing sheet to the tool by means of screw-in type holders or the like and an attachment method utilizing the tension of a spring as in a belt grinder. Depending on a particular type of tool used, a free choice may be made among well-known attachment methods.

EXAMPLE

Examples of the invention are given below together with Comparative Examples by way of illustration and not by way of limitation.

Example 1

A mixture of formulation No. 1 shown in Table 1 was uniformly milled in a roll mill set at 70° C., and a film of about 30 μm thick was then prepared by means of a hot press under conditions including a pressure of 0.1 kg/cm$^2$, 70° C. and 30 minutes. The film was laid on a polyester film of 50 μm thick and hot pressed under a pressure of 0.5 kg/cm$^2$ at 100° C. for 10 minutes, yielding a laminate. A binder/abrasive grain mixture in the form of a mixture of phenol adhesive and α-SiC (mean grain size 5 μm) in a weight ratio of 1:4 was coated onto one surface of the laminate (on the thermosetting adhesive composition side) to form an abrasive layer of 5 μm thick and heat treated in an oven at 150° C. for 60 minutes, obtaining a polishing sheet.

Example 2

Using a mixture of formulation No. 2 shown in Table 1, a laminate with a polyarylate was obtained by a similar procedure. A binder/abrasive grain mixture in the form of a mixture of phenol adhesive and alumina (mean grain size 5 μm) in a weight ratio of 1:4 was coated onto one surface of the laminate to form an abrasive layer of 10 μm thick and similarly heat treated, obtaining a polishing sheet.

Comparative Example 1

A polishing sheet was obtained as in Example 1 except that the thermosetting adhesive layer was omitted and the abrasive layer was formed directly on the polyester film.

Comparative Example 2

A polishing sheet was obtained as in Example 1 except that a tackifier (acrylic tackifier #500 manufactured by Nitto Denko K.K.) was used instead of the thermosetting adhesive layer.

Example 3

A polishing sheet was obtained by mixing a mixture of formulation No. 1 shown in Table 1 with α-SiC (mean grain size 5 μm) in a weight ratio of 1:4, applying the mixture to a polyester film of 50 μm thick to form an abrasive layer of 5 μm thick, and effecting heat treatment in an oven at 150° C. for 60 minutes.

Example 4

A polishing sheet was obtained as in Example 3 except that a polyarylate film was used instead of the polyester film.

Example 5

A polishing sheet was obtained by mixing a mixture of formulation No. 2 shown in Table 1 with alumina (mean grain size 5 μm) in a weight ratio of 1:4, applying the mixture to a polyester film of 50 μm thick to form an abrasive layer of 10 μm thick, and effecting heat treatment in an oven at 150° C. for 60 minutes.

Example 6

A polishing sheet was obtained as in Example 5 except that a polyarylate film was used instead of the polyester film.

TABLE 1

| Component (parts by weight) | Formulation No. 1 | Formulation No. 2 |
|---|---|---|
| Ultracene 635*[1] | 100 | 100 |
| Triallyl isocyanurate | 5 | — |
| Hydroxyethyl methacrylate | — | 5 |
| γ-methacryloxypropyltrimethoxysilane | 2 | — |
| γ-glycidoxypropyltriethoxysilane | — | 2 |
| Lauroyl peroxide | 3 | — |
| Benzoyl peroxide | — | 2 |

*[1]ethylene-vinyl acetate copolymer (vinyl acetate content 25%) by Toso K. K.

Example 7

A mixture of formulation No. 3 shown in Table 2 was uniformly milled in a roll mill set at 70° C., and a film of about 30 μm thick was then prepared by means of a hot press under conditions including a pressure of 0.1 kg/cm$^2$, 70° C. and 30 minutes. By following the same subsequent procedure as in Example 1, a polishing sheet was obtained.

Example 8

A polishing sheet was obtained as in Example 2 except that a mixture of formulation No. 4 shown in Table 2 was used.

Comparative Example 3

A polishing sheet was obtained as in Example 7 except that the thermosetting adhesive layer was omitted and the abrasive layer was formed directly on the polyester film.

Comparative Example 4

A polishing sheet was obtained as in Example 7 except that a tackifier (acrylic tackifier #500 manufactured by Nitto Denko K.K.) was used instead of the thermosetting adhesive layer.

Example 9

A polishing sheet was obtained by mixing a mixture of formulation No. 3 shown in Table 2 with α-SiC (mean grain size 5 μm) in a weight ratio of 1:4, applying the mixture to a polyester film of 50 μm thick to form an abrasive layer of 5 μm thick, and effecting heat treatment in an oven at 150° C. for 60 minutes.

Example 10

A polishing sheet was obtained as in Example 9 except that a polyarylate film was used instead of the polyester film.

Example 11

A polishing sheet was obtained by mixing a mixture of formulation No. 4 shown in Table 2 with alumina (mean grain size 5 μm) in a weight ratio of 1:4, applying the mixture to a polyester film of 50 μm thick to form an abrasive layer of 10 μm thick, and effecting heat treatment in an oven at 150° C. for 60 minutes.

Example 12

A polishing sheet was obtained as in Example 11 except that a polyarylate film was used instead of the polyester film.

TABLE 2

| Component (parts by weight) | Formulation No. 3 | Formulation No. 4 |
|---|---|---|
| Bonfirst 2A*2 | 100 | — |
| Bonfirst 2B*3 | — | 100 |
| Triallyl isocyanurate | 3 | — |
| Ethylene glycol dimethacrylate | — | 10 |
| γ-glycidoxypropyltrimethoxysilane | 1 | — |
| γ-methacryloxypropyltrimethoxysilane | — | 1 |
| Lauroyl peroxide | 2 | — |
| Benzoyl peroxide | — | 5 |

*2ethylene-vinyl acetate-glycidyl methacrylate copolymer (vinyl acetate content 8%, glycidyl methacrylate content 3%) by Sumitomo Chemical Industry K. K.
*3ethylene-vinyl acetate-glycidyl methacrylate copolymer (vinyl acetate content 5%, glycidyl methacrylate content 12%) by Sumitomo Chemical Industry K. K.

Example 13

A mixture of formulation No. 5 shown in Table 3 was uniformly milled in a roll mill set at 70° C., and a film of about 30 μm thick was then prepared by means of a hot press under conditions including a pressure of 0.1 kg/cm$^2$, 70° C. and 30 minutes. By following the same subsequent procedure as in Example 1, a polishing sheet was obtained.

Example 14

A polishing sheet was obtained as in Example 2 except that a mixture of formulation No. 6 shown in Table 3 was used.

Comparative Example 5

A polishing sheet was obtained as in Example 13 except that the thermosetting adhesive layer was omitted and the abrasive layer was formed directly on the polyester film.

Comparative Example 6

A polishing sheet was obtained as in Example 13 except that a tackifier (acrylic tackifier #500 manufactured by Nitto Denko K.K.) was used instead of the thermosetting adhesive layer.

Example 15

A polishing sheet was obtained by mixing a mixture of formulation No. 5 shown in Table 3 with α-SiC (mean grain size 5 μm) in a weight ratio of 1:4, applying the mixture to a polyester film of 50 μm thick to form an abrasive layer of 5 μm thick, and effecting heat treatment in an oven at 150° C. for 60 minutes.

Example 16

A polishing sheet was obtained as in Example 15 except that a polyarylate film was used instead of the polyester film.

Example 17

A polishing sheet was obtained by mixing a mixture of formulation No. 6 shown in Table 3 with alumina (mean grain size 5 μm) in a weight ratio of 1:4, applying the mixture to a polyester film of 50 μm thick to form an abrasive layer of 10 μm thick, and effecting heat treatment in an oven at 150° C. for 60 minutes.

Example 18

A polishing sheet was obtained as in Example 17 except that a polyarylate film was used instead of the polyester film.

TABLE 3

| Component (parts by weight) | Formulation No. 5 | Formulation No. 6 |
|---|---|---|
| Modic E-100H*4 | 100 | — |
| Modic E-100H*5 | — | 100 |
| Triallyl isocyanurate | 3 | — |
| Ethylene glycol dimethacrylate | — | 10 |
| γ-glycidoxypropyltrimethoxysilane | 1 | — |
| γ-methacryloxypropyltrimethoxysilane | — | 1 |
| Lauroyl peroxide | 2 | — |
| Benzoyl peroxide | — | 5 |

*4, *5ethylene-vinyl acetate-maleic anhydride terpolymer by Mitsubishi Chemical K. K.

Example 19

A mixture of formulation No. 7 shown in Table 4 was uniformly milled in a roll mill set at 70° C., and a film of about 30 μm thick was then prepared by means of a hot press under conditions including a pressure of 0.1 kg/cm$^2$, 70° C. and 30 minutes. By following the same subsequent procedure as in Example 1, a polishing sheet was obtained.

Example 20

A polishing sheet was obtained as in Example 2 except that a mixture of formulation No. 8 shown in Table 4 was used.

Comparative Example 7

A polishing sheet was obtained as in Example 19 except that the thermosetting adhesive layer was omitted and the abrasive layer was formed directly on the polyester film.

Comparative Example 8

A polishing sheet was obtained as in Example 19 except that a tackifier (acrylic tackifier #500 manufactured by Nitto Denko K.K.) was used instead of the thermosetting adhesive layer.

Example 21

A polishing sheet was obtained by mixing a mixture of formulation No. 7 shown in Table 4 with α-SiC (mean grain size 5 μm) in a weight ratio of 1:4, applying the mixture to a polyester film of 50 μm thick to form an abrasive layer of 5 μm thick, and effecting heat treatment in an oven at 150° C. for 60 minutes.

Example 22

A polishing sheet was obtained as in Example 21 except that a polyarylate film was used instead of the polyester film.

Example 23

A polishing sheet was obtained by mixing a mixture of formulation No. 8 shown in Table 4 with alumina (mean grain size 5 μm) in a weight ratio of 1:4, applying the mixture to a polyester film of 50 μm thick to form an abrasive layer of 10 μm thick, and effecting heat treatment in an oven at 150° C. for 60 minutes.

Example 24

A polishing sheet was obtained as in Example 23 except that a polyarylate film was used instead of the polyester film.

TABLE 4

| Component (parts by weight) | Formulation No. 7 | Formulation No. 8 |
|---|---|---|
| Bondyne AX8390*6 | 100 | 100 |
| Triallyl isocyanurate | 5 | — |
| Ethylene glycol dimethacrylate | — | 20 |
| γ-glycidoxypropyltrimethoxysilane | 0.5 | — |
| γ-methacryloxypropyltrimethoxysilane | — | 2 |
| Lauroyl peroxide | 1 | — |
| Benzoyl peroxide | — | 2 |

*6ethylene-ethyl acrylate-maleic anhydride copolymer (ethylene content 68%, ethyl acrylate content 30%, maleic anhydride content 2%) by Sumitomo Chemical Industry K. K.

Example 25

A mixture of formulation No. 9 shown in Table 5 was uniformly milled in a roll mill set at 70° C., and a film of about 30 μm thick was then prepared by means of a hot press under conditions including a pressure of 0.1 kg/cm$^2$, 70° C. and 30 minutes. By following the same subsequent procedure as in Example 1, a polishing sheet was obtained.

Example 26

A polishing sheet was obtained as in Example 2 except that a mixture of formulation No. 10 shown in Table 5 was used.

Comparative Example 9

A polishing sheet was obtained as in Example 25 except that the thermosetting adhesive layer was omitted and the abrasive layer was formed directly on the polyester film.

Comparative Example 10

A polishing sheet was obtained as in Example 25 except that a tackifier (acrylic tackifier #500 manufactured by Nitto Denko K.K.) was used instead of the thermosetting adhesive layer.

Example 27

A polishing sheet was obtained by mixing a mixture of formulation No. 9 shown in Table 5 with α-SiC (mean grain size 5 μm) in a weight ratio of 1:4, applying the mixture to a polyester film of 50 μm thick to form an abrasive layer of 5 μm thick, and effecting heat treatment in an oven at 150° C. for 60 minutes.

Example 28

A polishing sheet was obtained as in Example 27 except that a polyarylate film was used instead of the polyester film.

Example 29

A polishing sheet was obtained by mixing a mixture of formulation No. 10 shown in Table 5 with alumina (mean grain size 5 μm) in a weight ratio of 1:4, applying the mixture to a polyester film of 50 μm thick to form an abrasive layer of 10 μm thick, and effecting heat treatment in an oven at 150° C. for 60 minutes.

Example 30

A polishing sheet was obtained as in Example 29 except that a polyarylate film was used instead of the polyester film.

TABLE 5

| Component (parts by weight) | Formulation No. 9 | Formulation No. 10 |
|---|---|---|
| Himilan 1856*7 | 100 | — |
| Himilan 1707*8 | — | 100 |
| Triallyl isocyanurate | 5 | — |
| Ethylene glycol dimethacrylate | — | 20 |
| γ-glycidoxypropyltrimethoxysilane | 0.5 | — |
| γ-methacryloxypropyltrimethoxysilane | — | 2 |
| Lauroyl peroxide | 1 | — |
| Benzoyl peroxide | — | 2 |

*7, *8ethylene-methacrylic acid copolymer ionomer resin by Mitsui duPont Poly-Chemical K. K.

The polishing sheets thus obtained were evaluated for high-speed polishing performance and heat resistance upon polishing. Table 6 shows the results of polishing sheets using an adhesive layer of an adhesive composition within the scope of the invention. Table 7 shows the results of polishing sheets using an adhesive composition within the scope of the invention as a binder of an abrasive layer.

It is noted that high-speed polishing performance was evaluated by punching a polishing sheet into a disc having an outer diameter of 115 mm for a Disk grinder RS-115 by Ryobi K.K., drilling a hole, attaching magic tape, carrying out polishing operation, and measuring a maximum circumferential speed during the operation. Heat resistance was evaluated by observing the polishing sheet at the end of polishing operation to see whether or not interlaminar separation or deformation occurred.

TABLE 6

| | High-speed polishing performance (maximum circumferential speed, m/min.) | Heat resistance |
|---|---|---|
| Example 1 | >4000 | ○ |
| Example 2 | >4000 | ○ |
| Comparative Example 1 | <2000 | ○ |
| Comparative Example 2 | ~3000 | X |
| Example 7 | >4000 | ○ |
| Example 8 | >4000 | ○ |
| Comparative Example 3 | <2000 | ○ |

TABLE 6-continued

| | High-speed polishing performance (maximum circumferential speed, m/min.) | Heat resistance |
|---|---|---|
| Comparative Example 4 | ~3000 | X |
| Example 13 | >4000 | ○ |
| Example 14 | >4000 | ○ |
| Comparative Example 5 | <2000 | ○ |
| Comparative Example 6 | ~3000 | X |
| Example 19 | >4000 | ○ |
| Example 20 | >4000 | ○ |
| Comparative Example 7 | <2000 | ○ |
| Comparative Example 8 | ~3000 | X |
| Example 25 | >4000 | ○ |
| Example 26 | >4000 | ○ |
| Comparative Example 9 | <2000 | ○ |
| Comparative Example 10 | ~3000 | X |

TABLE 7

| | High-speed polishing performance (maximum circumferential speed, m/min.) | Heat resistance |
|---|---|---|
| Example 3 | >4000 | ○ |
| Example 4 | >4000 | ○ |
| Example 5 | >4000 | ○ |
| Example 6 | >4000 | ○ |
| Example 9 | >4000 | ○ |
| Example 10 | >4000 | ○ |
| Example 11 | >4000 | ○ |
| Example 12 | >4000 | ○ |
| Example 15 | >4000 | ○ |
| Example 16 | >4000 | ○ |
| Example 17 | >4000 | ○ |
| Example 18 | >4000 | ○ |
| Example 21 | >4000 | ○ |
| Example 22 | >4000 | ○ |
| Example 23 | >4000 | ○ |
| Example 24 | >4000 | ○ |
| Example 27 | >4000 | ○ |
| Example 28 | >4000 | ○ |
| Example 29 | >4000 | ○ |
| Example 30 | >4000 | ○ |

Example 31

In 80 grams of toluene at 50° C. was uniformly dissolved 20 grams of a mixture of formulation No. 11 shown in Table 8. This solution was applied onto a polyether sulfone film (gage 100 μm) and dried in an oven at 50° C. for one hour to remove the solvent, obtaining a laminate having a photo-curable adhesive composition layer with a dry thickness of 20 μm. Prior to formation of an abrasive layer, the laminate surface was exposed to a high-pressure mercury lamp of 4 kW for 1 minute to induce partial curing of the curable composition layer. A binder/abrasive grain mixture in the form of a mixture of phenol adhesive and alumina (mean grain size 5 μm) in a weight ratio of 1:4 was coated onto one surface of the laminate to form an abrasive layer of 10 μm thick and heat treated in an oven at 150° C. for 60 minutes, obtaining a polishing sheet.

Example 32

Using a mixture of formulation No. 12 shown in Table 8, a polishing sheet was obtained by the same procedure as in Example 31 except that among the curing conditions of the photo-curable adhesive composition layer, an exposure time of 5 minutes under a high-pressure mercury lamp of 4 kW was used for complete curing.

Comparative Example 11

A polishing sheet was obtained as in Example 31 except that the photo-curable adhesive layer was omitted and the abrasive layer was formed directly on the polyester film.

Comparative Example 12

A polishing sheet was obtained as in Example 31 except that a tackifier (acrylic tackifier #500 manufactured by Nitto Denko K.K.) was used instead of the photo-curable adhesive layer.

Example 33

A polishing sheet was obtained by mixing a mixture of formulation No. 11 shown in Table 8 with α-SiC (mean grain size 5 μm) in a weight ratio of 1:4, applying the mixture to a polyester film of 50 μm thick to form an abrasive layer of 5 μm thick, exposing the layer to a high-pressure mercury lamp of 4 kW for 1 minute, and effecting heat treatment in an oven at 150° C. for 60 minutes.

Example 34

A polishing sheet was obtained as in Example 33 except that a polyarylate film was used instead of the polyester film.

Example 35

A polishing sheet was obtained by mixing a mixture of formulation No. 12 shown in Table 8 with alumina (mean grain size 5 μm) in a weight ratio of 1:4, applying the mixture to a polyester film of 50 μm thick to form an abrasive layer of 10 μm thick, and exposing the layer to a high-pressure mercury lamp of 4 kW for 5 minutes.

Example 36

A polishing sheet was obtained as in Example 35 except that a polyarylate film was used instead of the polyester film.

TABLE 8

| | Formulation | |
|---|---|---|
| Component (parts by weight) | No. 11 | No. 12 |
| Ultracene 635*9 | 100 | 100 |
| Trimethylolpropane triacrylate | 5 | 5 |
| γ-methacryloxypropyltrimethoxysilane | 1 | 0.5 |
| γ-glycidoxypropyltriethoxysilane | 1 | 5 |
| Benzoyl peroxide | 0.5 | — |
| Benzyl dimethyl ketal | 2 | 2 |

*9 ethylene-vinyl acetate copolymer (vinyl acetate content 25%) by Toso K.K.

Example 37

In 80 grams of toluene at 50° C. was uniformly dissolved 20 grams of a mixture of formulation No. 13 shown in Table 9. This solution was applied onto a polyether sulfone film (gage 100 μm) and dried in an oven at 50° C. for one hour to remove the solvent, obtaining a laminate having a photo-curable adhesive composition layer with a dry thickness of 20 μm. By following the same subsequent procedure as in Example 31, a polishing sheet was obtained.

Example 38

A polishing sheet was obtained as in Example 32 except that a mixture of formulation No. 14 shown in Table 9 was used.

Comparative Example 13

A polishing sheet was obtained as in Example 37 except that the photo-curable adhesive layer was omitted and the abrasive layer was formed directly on the polyester film.

Comparative Example 14

A polishing sheet was obtained as in Example 37 except that a tackifier (acrylic tackifier #500 manufactured by Nitto Denko K.K.) was used instead of the photo-curable adhesive layer.

Example 39

A polishing sheet was obtained by mixing a mixture of formulation No. 13 shown in Table 9 with α-SiC (mean grain size 5 μm) in a weight ratio of 1:4, applying the mixture to a polyester film of 50 μm thick to form an abrasive layer of 5 μm thick, exposing the layer to a high-pressure mercury lamp of 4 kW for 1 minute, and effecting heat treatment in an oven at 150° C. for 60 minutes.

Example 40

A polishing sheet was obtained as in Example 39 except that a polyarylate film was used instead of the polyester film.

Example 41

A polishing sheet was obtained by mixing a mixture of formulation No. 14 shown in Table 9 with alumina (mean grain size 5 μm) in a weight ratio of 1:4, applying the mixture to a polyester film of 50 μm thick to form an abrasive layer of 10 μm thick, and exposing the layer to a high-pressure mercury lamp of 4 kW for 5 minutes.

Example 42

A polishing sheet was obtained as in Example 41 except that a polyarylate film was used instead of the polyester film.

TABLE 9

| Component (parts by weight) | Formulation No. 13 | Formulation No. 14 |
|---|---|---|
| Bonfirst 2A*10 | 100 | 100 |
| Trimethylolpropane triacrylate | 5 | 5 |
| γ-methacryloxypropyltrimethoxysilane | 1 | 1 |
| Benzoyl peroxide | 1 | — |
| Benzoin isopropyl ether | 1 | — |
| Benzyl dimethyl ketal | — | 2 |

*10ethylene-vinyl acetate-glycidyl methacrylate copolymer (vinyl acetate content 8%, glycidyl methacrylate content 3%) by Sumitomo Chemical Industry K. K.

Example 43

In 80 grams of toluene at 50° C. was uniformly dissolved 20 grams of a mixture of formulation No. 15 shown in Table 10. This solution was applied onto a polyether sulfone film (gage 100 μm) and dried in an oven at 50° C. for one hour to remove the solvent, obtaining a laminate having a photo-curable adhesive composition layer with a dry thickness of 20 μm. By following the same subsequent procedure as in Example 31, a polishing sheet was obtained.

Example 44

A polishing sheet was obtained as in Example 32 except that a mixture of formulation No. 16 shown in Table 10 was used.

Comparative Example 15

A polishing sheet was obtained as in Example 43 except that the photo-curable adhesive layer was omitted and the abrasive layer was formed directly on the polyester film.

Comparative Example 16

A polishing sheet was obtained as in Example 43 except that a tackifier (acrylic tackifier #500 manufactured by Nitto Denko K.K.) was used instead of the photo-curable adhesive layer.

Example 45

A polishing sheet was obtained by mixing a mixture of formulation No. 15 shown in Table 10 with α-SiC (mean grain size 5 μm) in a weight ratio of 1:4, applying the mixture to a polyester film of 50 μm thick to form an abrasive layer of 5 μm thick, exposing the layer to a high-pressure mercury lamp of 4 kW for 1 minute, and effecting heat treatment in an oven at 150° C. for 60 minutes.

Example 46

A polishing sheet was obtained as in Example 45 except that a polyarylate film was used instead of the polyester film.

Example 47

A polishing sheet was obtained by mixing a mixture of formulation No. 16 shown in Table 10 with alumina (mean grain size 5 μm) in a weight ratio of 1:4, applying the mixture to a polyester film of 50 μm thick to form an abrasive layer of 10 μm thick, and exposing the layer to a high-pressure mercury lamp of 4 kW for 5 minutes.

Example 48

A polishing sheet was obtained as in Example 47 except that a polyarylate film was used instead of the polyester film.

TABLE 10

| Component (parts by weight) | Formulation No. 15 | Formulation No. 16 |
|---|---|---|
| Modic E-100H*11 | 100 | — |
| Modic E-100H*12 | — | 100 |
| Triallyl isocyanurate | 5 | — |
| Ethylene glycol dimethacrylate | — | 20 |
| γ-glycidoxypropyltrimethoxysilane | 0.5 | — |
| γ-methacryloxypropyltrimethoxysilane | — | 2 |
| Benzoyl peroxide | 1 | — |
| Benzoin isopropyl ether | 1 | — |
| Benzophenone | — | 2 |

*11, *12ethylene-vinyl acetate-maleic anhydride terpolymer by Mitsubishi Chemical K. K.

Example 49

In 80 grams of toluene at 50° C. was uniformly dissolved 20 grams of a mixture of formulation No. 17 shown in Table 11. This solution was applied onto a polyether sulfone film (gage 100 μm) and dried in an oven at 50° C. for one hour to remove the solvent, obtaining a laminate having a photo-curable adhesive composition layer with a dry thickness of 20 μm. By following the same subsequent procedure as in Example 31, a polishing sheet was obtained.

Example 50

A polishing sheet was obtained as in Example 32 except that a mixture of formulation No. 18 shown in Table 11 was used.

Comparative Example 17

A polishing sheet was obtained as in Example 49 except that the photo-curable adhesive layer was omitted and the abrasive layer was formed directly on the polyester film.

Comparative Example 18

A polishing sheet was obtained as in Example 49 except that a tackifier (acrylic tackifier #500 manufactured by Nitto Denko K.K.) was used instead of the photo-curable adhesive layer.

Example 51

A polishing sheet was obtained by mixing a mixture of formulation No. 17 shown in Table 11 with α-SiC (mean grain size 5 μm) in a weight ratio of 1:4, applying the mixture to a polyester film of 50 μm thick to form an abrasive layer of 5 μm thick, exposing the layer to a high-pressure mercury lamp of 4 kW for 1 minute, and effecting heat treatment in an oven at 150° C. for 60 minutes.

Example 52

A polishing sheet was obtained as in Example 51 except that a polyarylate film was used instead of the polyester film.

Example 53

A polishing sheet was obtained by mixing a mixture of formulation No. 18 shown in Table 11 with alumina (mean grain size 5 μm) in a weight ratio of 1:4, applying the mixture to a polyester film of 50 μm thick to form an abrasive layer of 10 μm thick, and exposing the layer to a high-pressure mercury lamp of 4 kW for 5 minutes.

Example 54

A polishing sheet was obtained as in Example 53 except that a polyarylate film was used instead of the polyester film.

TABLE 11

| Component (parts by weight) | Formulation No. 17 | Formulation No. 18 |
|---|---|---|
| Bondyne AX8390*13 | 100 | 100 |
| Triallyl isocyanurate | 5 | — |
| Ethylene glycol dimethacrylate | — | 20 |
| γ-glycidoxypropyltrimethoxysilane | 0.5 | — |
| γ-methacryloxypropyltrimethoxysilane | — | 2 |
| Benzoyl peroxide | 1 | — |
| Benzoin isopropyl ether | 1 | — |
| Benzophenone | — | 2 |

*13ethylene-ethyl acrylate-maleic anhydride copolymer (ethylene content 68%, ethyl acrylate content 30%, maleic anhydride content 2%) by Sumitomo Chemical Industry K. K.

Example 55

In 80 grams of toluene at 50° C. was uniformly dissolved 20 grams of a mixture of formulation No. 19 shown in Table 12. This solution was applied onto a polyether sulfone film (gage 100 μm) and dried in an oven at 50° C. for one hour to remove the solvent, obtaining a laminate having a photo-curable adhesive composition layer with a dry thickness of 20 μm. By following the same subsequent procedure as in Example 31, a polishing sheet was obtained.

Example 56

A polishing sheet was obtained as in Example 32 except that a mixture of formulation No. 20 shown in Table 12 was used.

Comparative Example 19

A polishing sheet was obtained as in Example 55 except that the photo-curable adhesive layer was omitted and the abrasive layer was formed directly on the polyester film.

Comparative Example 20

A polishing sheet was obtained as in Example 55 except that a tackifier (acrylic tackifier #500 manufactured by Nitto Denko K.K.) was used instead of the photo-curable adhesive layer.

Example 57

A polishing sheet was obtained by mixing a mixture of formulation No. 19 shown in Table 12 with α-SiC (mean grain size 5 μm) in a weight ratio of 1:4, applying the mixture to a polyester film of 50 μm thick to form an abrasive layer of 5 μm thick, exposing the layer to a high-pressure mercury lamp of 4 kW for 1 minute, and effecting heat treatment in an oven at 150° C. for 60 minutes.

Example 58

A polishing sheet was obtained as in Example 57 except that a polyarylate film was used instead of the polyester film.

Example 59

A polishing sheet was obtained by mixing a mixture of formulation No. 20 shown in Table 12 with alumina (mean grain size 5 μm) in a weight ratio of 1:4, applying the mixture to a polyester film of 50 μm thick to form an abrasive layer of 10 μm thick, and exposing the layer to a high-pressure mercury lamp of 4 kw for 5 minutes.

Example 60

A polishing sheet was obtained as in Example 59 except that a polyarylate film was used instead of the polyester film.

TABLE 12

| Component (parts by weight) | Formulation No. 19 | Formulation No. 20 |
|---|---|---|
| Himilan 1856*14 | 100 | — |
| Himilan 1707*15 | — | 100 |
| Triallyl isocyanurate | 5 | — |
| Ethylene glycol dimethacrylate | — | 20 |
| γ-glycidoxypropyltrimethoxysilane | 0.5 | — |
| γ-methacryloxypropyltrimethoxysilane | — | 2 |
| Benzoyl peroxide | 1 | — |
| Benzoin isopropyl ether | 1 | — |
| Benzophenone | — | 2 |

*14, *15ethylene-methacrylic acid copolymer ionomer resin by Mitsui duPont Poly-Chemical K. K.

The polishing sheets thus obtained were evaluated for high-speed polishing performance and heat resistance upon polishing. Table 13 shows the results of polishing sheets using an adhesive layer of an adhesive composition within the scope of the invention. Table 14 shows the results of polishing sheets using an adhesive composition within the scope of the invention as a binder of an abrasive layer.

TABLE 13

| | High-speed polishing performance (maximum circumferential speed, m/min.) | Heat resistance |
|---|---|---|
| Example 31 | >4000 | ○ |
| Example 32 | >4000 | ○ |
| Comparative Example 11 | <2000 | ○ |
| Comparative Example 12 | ~3000 | X |
| Example 37 | >4000 | ○ |
| Example 38 | >4000 | ○ |
| Comparative Example 13 | <2000 | ○ |
| Comparative Example 14 | ~3000 | X |
| Example 43 | >4000 | ○ |
| Example 44 | >4000 | ○ |
| Comparative Example 15 | <2000 | ○ |
| Comparative Example 16 | ~3000 | X |
| Example 49 | >4000 | ○ |
| Example 50 | >4000 | ○ |
| Comparative Example 17 | <2000 | ○ |
| Comparative Example 18 | ~3000 | X |
| Example 55 | >4000 | ○ |
| Example 56 | >4000 | ○ |
| Comparative Example 19 | <2000 | ○ |
| Comparative Example 20 | ~3000 | X |

TABLE 14

| | High-speed polishing performance (maximum circumferential speed, m/min.) | Heat resistance |
|---|---|---|
| Example 33 | >4000 | ○ |
| Example 34 | >4000 | ○ |
| Example 35 | >4000 | ○ |
| Example 36 | >4000 | ○ |
| Example 39 | >4000 | ○ |
| Example 40 | >4000 | ○ |
| Example 41 | >4000 | ○ |
| Example 42 | >4000 | ○ |
| Example 45 | >4000 | ○ |
| Example 46 | >4000 | ○ |
| Example 47 | >4000 | ○ |
| Example 48 | >4000 | ○ |
| Example 51 | >4000 | ○ |
| Example 52 | >4000 | ○ |
| Example 53 | >4000 | ○ |
| Example 54 | >4000 | ○ |
| Example 57 | >4000 | ○ |
| Example 58 | >4000 | ○ |
| Example 59 | >4000 | ○ |
| Example 60 | >4000 | ○ |

As seen from the Tables, the polishing sheets of Examples show high-speed polishing performance as demonstrated by a maximum circumferential speed of higher than 4,000 m/min. On the other hand, the speed in Comparative Examples is lower than 3,000 m/min., indicating an outstanding difference.

It was proven by these data that a polishing sheet having significantly improved high-speed polishing performance and superior polishing efficiency is provided by providing an elastic adhesive layer according to the invention between a support and an abrasive layer and by using a composition according to the invention as a binder of an abrasive layer.

Also, with respect to heat resistance, the Examples revealed no changes of outer appearance such as separation and deformation at the end of polishing operation. Among Comparative Examples, in those polishing sheets using a tackifier which had elasticity, but was inferior in adhesion to a support and an abrasive layer and heat resistance, separation between the support and the tackifier layer and failure of the abrasive layer were observed at the end of polishing operation, indicating that simply providing an elastic layer between the support and the abrasive layer is ineffective. It is seen that only the polishing sheets having interposed an adhesive layer according to the invention can attain the objects of the invention.

Accordingly, the polishing sheets of the present invention are excellent in polishing efficiency and precision and show good high-speed polishing performance and heat resistance.

What is claimed is:

1. A polishing sheet comprising a support and an abrasive layer formed thereon with an adhesive layer interposed therebetween, characterized in that said adhesive layer is formed by a cured layer of a thermosetting or photo-curable adhesive composition based on at least one resin selected from the group consisting of, (A) an ethylene-vinyl acetate copolymer, (B) a copolymer of ethylene, vinyl acetate, and an acrylate or methacrylate monomer, (C) a copolymer of ethylene, vinyl acetate, and maleic acid or maleic anhydride, (D) a copolymer of ethylene, an acrylate or methacrylate monomer, and maleic acid or maleic anhydride, and (E) an ionomer resin in the form of an ethylene-methacrylic acid copolymer whose molecules are bonded by a metal ion, and wherein said thermosetting or photo-curable adhesive composition further comprises 0.1 to 10 parts by weight of an organic peroxide added per 100 parts by weight of said resin.

2. The polishing sheet of claim 1 wherein said adhesive composition further comprises 0.1 to 10 parts by weight of a photosensitizer added per 100 parts by weight of said resin.

3. The polishing sheet of claim 1 wherein said thermosetting or photo-curable adhesive composition further comprises 0.01 to 10 parts by weight of a silane coupling agent added per 100 parts by weight of said resin.

4. The polishing sheet of claim 1 wherein said thermosetting or photo-curable adhesive composition further comprises 0.1 to 20 parts by weight of an epoxy group-containing compound added per 100 parts by weight of said resin.

5. The polishing sheet of claim 1 wherein said thermosetting or photo-curable adhesive composition further comprises 0.1 to 50 parts by weight of at least one of an acryloxy group-containing compound, methacryloxy group-containing compound and allyl group-containing compound added per 100 parts by weight of said resin.

6. The polishing sheet of claim 1 wherein said support is a heat resistant support based on an organic resin and having a glass transition temperature of at least 60° C. or a melting point of at least 100° C.

7. A polishing sheet comprising a support and an abrasive layer formed thereon directly or with an adhesive layer interposed therebetween, characterized in that said abrasive layer comprises abrasive grains and a binder which is a thermosetting or photo-curable adhesive composition based on at least one resin selected from the group consisting of, (A) an ethylene-vinyl acetate copolymer, (B) a copolymer of ethylene, vinyl acetate, and an acrylate or methacrylate monomer, (C) a copolymer of ethylene, vinyl acetate, and maleic acid or maleic anhydride, (D) a copolymer of ethylene, an acrylate or methacrylate monomer, and maleic acid or maleic anhydride, and (E) an ionomer resin in the form of an ethylene-methacrylic acid copolymer whose molecules are bonded by a metal ion, the abrasive grains being bound with a cured product of said adhesive composition, and wherein said adhesive composition further comprises 0.1 to 10 parts by weight of an organic peroxide added per 100 parts by weight of said resin.

8. The polishing sheet of claim 7 wherein said adhesive layer is formed by a cured layer of a thermosetting or photo-curable adhesive composition based on at least one resin selected from the group consisting of (A) an ethylene-vinyl acetate copolymer, (B) a copolymer of ethylene, vinyl acetate, and an acrylate or methacrylate monomer, (C) a copolymer of ethylene, vinyl acetate, and maleic acid or maleic anhydride, (D) a copolymer of ethylene, an acrylate or methacrylate monomer, and maleic acid or maleic anhydride, and (E) an ionomer resin in the form of an ethylene-methacrylic acid copolymer whose molecules are bonded by a metal ion.

9. The polishing sheet of claim 7 or 8 wherein said thermosetting or photo-curable adhesive composition further comprises 0.1 to 10 parts by weight of an organic peroxide added per 100 parts by weight of said resin.

10. The polishing sheet of claim 7 or 8 wherein said thermosetting or photo-curable adhesive composition further comprises 0.1 to 10 parts by weight of a photosensitizer added per 100 parts by weight of said resin.

11. The polishing sheet of claim 7 or 8 wherein said thermosetting or photo-curableadhesive composition further comprises 0.01 to 10 parts by weight of a silane coupling agent added per 100 parts by weight of said resin.

12. The polishing sheet of claim 7 or 8 wherein said thermosetting or photo-curable adhesive composition further comprises 0.1 to 20 parts by weight of an epoxy group-containing compound added per 100 parts by weight of said resin.

13. The polishing sheet of claim 7 or 8 wherein said thermosetting or photo-curable adhesive composition further comprises 0.1 to 50 parts by weight of at least one of an acryloxy group-containing compound, methacryloxy group-containing compound and allyl group-containing compound added per 100 parts by weight of said resin.

14. The polishing sheet of claim 7 or 8 wherein said support is a heat resistant support based on an organic resin and having a glass transition temperature of at least 60° C. or a melting point of at least 100° C.

15. A polishing sheet comprising a support and an abrasive layer formed thereon with an adhesive layer interposed therebetween, characterized in that said adhesive layer is formed by a cured layer of a thermosetting or photo-curable adhesive composition based on at least one resin selected from the group consisting of, (A) an ethylene-vinyl acetate copolymer, (B) a copolymer of ethylene, vinyl acetate, and an acrylate or methacrylate monomer, (C) a copolymer of ethylene, vinyl acetate, and maleic acid or maleic anhydride, (D) a copolymer of ethylene, an acrylate or methacrylate monomer, and maleic acid or maleic anhydride, and (E) an ionomer resin in the form of an ethylene-methacrylic acid copolymer whose molecules are bonded by a metal ion, and wherein said adhesive composition further comprises 0.1 to 10 parts by weight of a photosensitizer added per 100 parts by weight of said resin.

16. The polishing sheet of claim 15 wherein said adhesive composition further comprises 0.1 to 10 parts by weight of an organic peroxide added per 100 parts by weight of said resin.

17. The polishing sheet of claim 16 wherein said thermosetting or photo-curable adhesive composition further comprises 0.01 to 10 parts by weight of a silane coupling agent added per 100 parts by weight of said resin.

18. The polishing sheet of claim 16 wherein said thermosetting or photo-curable adhesive composition further comprises 0.1 to 20 parts by weight of an epoxy group-containing compound added per 100 parts by weight of said resin.

19. The polishing sheet of claim 16 wherein said thermosetting or photo-curable adhesive composition further comprises 0.1 to 50 parts by weight of at least one of an acryloxy group-containing compound, methacryloxy group-containing compound and allyl group-containing compound added per 100 parts by weight of said resin.

20. The polishing sheet of claim 16 wherein said support is a heat resistant support based on an organic resin and having a glass transition temperature of at least 60° C. or a melting point of at least 100° C.

21. A polishing sheet comprising a support and an abrasive layer formed thereon directly or with an adhesive layer interposed therebetween, characterized in that said abrasive layer comprises abrasive grains and a binder which is a thermosetting or photo-curable adhesive composition based on at least one resin selected from the group consisting of, (A) an ethylene-vinyl acetate copolymer, (B) a copolymer of ethylene, vinyl acetate, and an acrylate or methacrylate monomer, (C) a copolymer of ethylene, vinyl acetate, and maleic acid or maleic anhydride, (D) a copolymer of ethylene, an acrylate or methacrylate monomer, and maleic acid or maleic anhydride, and (E) an ionomer resin in the form of an ethylene-methacrylic acid copolymer whose molecules are bonded by a metal ion, the abrasive grains being bound with a cured product of said adhesive composition, and wherein said thermosetting or photo-curable adhesive composition further comprises 0.1 to 10 parts by weight of a photosensitizer added per 100 parts by weight of said resin.

22. The polishing sheet of claim 21 wherein said adhesive layer is formed by a cured layer of a thermosetting or photo-curable adhesive composition based on at least one resin selected from the group consisting of (A) an ethylene-vinyl acetate copolymer, (B) a copolymer of ethylene, vinyl acetate, and an acrylate or methacrylate monomer, (C) a copolymer of ethylene, vinyl acetate, and maleic acid or maleic anhydride, (D) a copolymer of ethylene, an acrylate or methacrylate monomer, and maleic acid or maleic anhydride, and (E) an ionomer resin in the form of an ethylene-methacrylic acid copolymer whose molecules are bonded by a metal ion.

23. The polishing sheet of claim 21 wherein said thermosetting or photo-curable adhesive composition further comprises 0.01 to 10 parts by weight of a silane coupling agent added per 100 parts by weight of said resin.

24. The polishing sheet of claim 21 wherein said thermosetting or photo-curable adhesive composition further comprises 0.1 to 20 parts by weight of an epoxy group-containing compound added per 100 parts by weight of said resin.

25. The polishing sheet of claim 21 wherein said thermosetting or photo-curable adhesive composition further comprises 0.1 to 50 parts by weight of at least one of an acryloxy group-containing compound, methacryloxy group-containing compound and allyl group-containing compound added per 100 parts by weight of said resin.

26. The polishing sheet of claim 21 wherein said support is a heat resistant support based on an organic resin and having a glass transition temperature of at least 60° C. or a melting point of at least 100° C.

* * * * *